US006098441A

United States Patent [19]

Hada et al.

[11] Patent Number: 6,098,441

[45] Date of Patent: Aug. 8, 2000

[54] METHOD FOR FORMING A THROUGH-HOLE THROUGH THE CIRCUMFERENTIAL WALL OF A METAL PIPE AND A METAL PIPE WORKED BY THE SAID METHOD

[75] Inventors: Hiroshi Hada; Kazunori Takikawa, both of Numazu, Japan

[73] Assignee: USUI Kokusai Sangyo Kaisha Ltd., Shizuoka Prefecture, Japan

[21] Appl. No.: 09/190,316

[22] Filed: Nov. 12, 1998

[30] Foreign Application Priority Data

| | | | |
|---|---|---|---|
| Nov. 14, 1997 | [JP] | Japan | 9-330918 |
| Apr. 8, 1998 | [JP] | Japan | 10-112791 |
| Apr. 8, 1998 | [JP] | Japan | 10-112793 |

[51] Int. Cl.[7] ..... B21D 28/28

[52] U.S. Cl. ..... 72/370.27; 29/890.142; 239/568

[58] Field of Search ..... 72/71, 325, 370.27; 83/54; 29/890.142; 239/568, 601

[56] References Cited

U.S. PATENT DOCUMENTS

| | | | |
|---|---|---|---|
| 4,161,873 | 7/1979 | Mabery | 29/890.142 |
| 4,457,200 | 7/1984 | Borzym | 83/54 |
| 5,544,514 | 8/1996 | Maier et al. | 29/890.142 |

FOREIGN PATENT DOCUMENTS

| | | | |
|---|---|---|---|
| 2359794 | 6/1974 | Germany | 72/71 |

*Primary Examiner*—Lowell A. Larson
*Attorney, Agent, or Firm*—Anthony J. Casella; Gerald E. Hespos; Michael J. Porco

[57] ABSTRACT

A method for forming a through-hole through the circumferential wall of a metal pipe includes the steps of forming at least a thin portion by removing an outside circumferential surface portion of a metal pipe, and forming a through-hole in the thin portion from outside or inside and, at the same time, forming a cylindrical burring wall on the inside or outside circumferential surface side of the metal pipe. The through-hole may be formed by pressing the thin portion from outside with a punch. Alternatively, a preparatory through-hole may be formed together with the thin portion by removing the outside circumferential surface portion of the metal pipe. As a further alternative, the through-hole may be formed from outside with a punch having a larger diameter than the preparatory through-hole, or may be formed by pressing the thin portion from outside or inside by means of fluid pressure or a sphere.

19 Claims, 13 Drawing Sheets

METHOD FOR FORMING A THROUGH-HOLE THROUGH THE CIRCUMFERENTIAL WALL OF A METAL PIPE AND A METAL PIPE WORKED BY THE SAID METHOD

BACKGROUND OF THE INVENTION

1. Field of the Invention

The present invention relates to a method for forming a through-hole through the circumferential wall of a metal pipe and a metal pipe worked by the said method. More specifically, the invention relates to metal pipes having many branch holes in the outside circumferential surface, such as a cooling oil jet pipe that mainly serves to cool the cylinder or the piston of an engine and a lubrication oil jet pipe that is used in, for example, a system for supplying (jetting) a lubricant to a sliding portion such as a crank shaft or a cam shaft.

2. Description of the Prior Art

In metal pipes such as a cooling oil jet pipe for cooling the cylinder or the piston of an engine and a lubrication oil jet pipe used in, for example, a system for supplying (jetting) a lubricant to a sliding portion such as a crank shaft or a cam shaft, oil jetting nozzles are attached to the circumferential wall of a pipe body. For example, in conventional metal pipes of the above kind, nozzle pipes or branch pipes are brazed to respective through-holes that are formed through the circumferential wall of a pipe body.

However, the manufacture of metal pipes of the above kind has the following problems.

Common methods of forming through-holes through the circumferential wall of a metal pipe include (1) a method of forming through-holes with a drill, (2) a method of forming through-holes with a punch without inserting a core bar into a pipe, (3) a method of forming through-holes by inserting a core bar into a pipe, and (4) a method of forming through-holes with a laser. In the drilling method (1), chips may go into the inside of a pipe or a burr may be formed at each inside opening portion and much time and labor are needed to remove those chips and burrs. In the punch method (2) without a core bar, a large recess (shear droop) that may be formed at each outside opening portion impairs the shape of a metal pipe. Further, as in the case of method (1), a burr may be formed at each inside opening portion and some operation is needed to remove such burrs. In addition,, depending on the material of a metal pipe itself, particularly when the metal pipe or through-holes to be formed are small in diameter, the punch may be broken and hence it is difficult to form through-holes. In the punch method (3) using a core bar, the hole forming operation requires much time and labor because time and labor are needed for positioning of the core bar and the core bar needs to be moved for each hole forming position. It is necessary to remove punching chips that have dropped inside the core bar. If a burr is formed even at only one inside opening portion, it becomes difficult to pull out the core bar. Further, the hole forming operation cannot be performed on a portion between bent portions formed by bending a metal pipe. The laser method (4) is costly and dangerous to a human body. When a metal pipe is small in diameter, there is a possibility that a portion on the inside surface that is opposed to a through-hole formed may be damaged. Further, a droop may occur around a through-hole formed, or sputters may splash onto the inside surface of a metal pipe.

Where nozzle pipes or branch pipes are brazed to respective through-holes formed by any of the above methods, the brazing area is small because of a short radial length of through-holes, which causes problems that sufficient brazing strength is not secured and that the attachment direction of the nozzle pipes or the branch pipes becomes erroneous.

SUMMARY OF THE INVENTION

The present invention has been made to solve the above problems in the art, and an object of the invention is therefore to provide a method capable of forming easily, without causing the above problems in the art, through-holes having a desired diameter, preferably a small diameter, through the circumferential wall of a metal even if the metal pipe has a small diameter.

Another object of the invention is to provide a metal pipe that uses through-holes formed by the above method as branch holes as oil jetting branch holes and that can be used as a cooling oil jet pipe or a lubrication oil jet pipe.

To attain the above objects, according to a first aspect of the invention, there is provided a method for forming a through-hole through a circumferential wall of a metal pipe, comprising the steps of forming at least a thin portion by removing an outside circumferential surface portion of a metal pipe; and forming a through-hole in the thin portion from outside or inside and, at the same time, forming a cylindrical burring wall on an inside or outside circumferential surface side of the metal pipe.

In the above method, the through-hole may be formed by pressing the thin portion from outside with a punch. Alternatively, a preparatory through-hole may be formed together with the thin portion by removing the outside circumferential surface portion of the metal pipe. As a further alternative, the through-hole may be formed from outside with a punch having a larger diameter than the preparatory through-hole, or may be formed by pressing the thin portion from outside or inside by means of fluid pressure or a sphere.

According to a second aspect of the invention, there is provided a method for forming a through-hole through a circumferential wall of a metal pipe, comprising the steps of forming a thin portion by removing an outside circumferential surface portion of a metal pipe; and forming a through-hole by pressing the thin portion from outside with a punch and, at the same time, forming a cylindrical burring wall on an inside circumferential surface side of the metal pipe.

According to a third aspect of the invention, there is provided a method for forming a through-hole through a circumferential wall of a metal pipe, comprising the steps of forming a thin portion and a preparatory through-hole by removing an outside circumferential surface portion of a metal pipe; forming a through-hole by pressing the thin portion from outside with a punch having a larger diameter than the preparatory through-hole; and forming a cylindrical burring wall on an inside circumferential surface side of the metal pipe.

According to a fourth aspect of the invention, there is provided a method for forming a through-hole through a circumferential wall of a metal pipe, comprising the steps of forming a thin portion by removing an outside circumferential surface portion of a metal pipe; and forming a through-hole by pressing the thin portion from outside or inside by means of fluid pressure or a sphere and, at the same time, forming a cylindrical burring wall on an inside or outside circumferential surface side of the metal pipe.

According to a fifth aspect of the invention, there is provided a metal pipe having at least one branch hole in a circumferential wall, the metal pipe being formed with a through-hole in a thin portion of the circumferential wall formed by removing an outside circumferential surface portion of the metal pipe, the through-hole having a burring wall projecting from an inside or outside circumferential surface of the metal pipe.

In the invention, the reasons why a thin portion (and a preparatory through-hole) is formed by removing an outside circumferential surface portion of a metal pipe are to facilitate formation of a through-hole by means of fluid pressure or a sphere without using a core bar and enable formation of a through-hole in such a manner that almost no recess (shearing droop) is formed at the outside opening portion, to form a burring wall, preferably a cylindrical one, on the pipe inside or outside circumferential surface side when a through-hole is formed by means of a punch, fluid pressure, or a sphere, to thereby secure a sufficient axial length of the through-hole, and to prevent formation of a shearing droop at the boundary between the pipe outside circumferential surface and a through-hole and preferably form an edge shape there.

For example, an outside circumferential surface portion of a metal pipe may be removed (and a preparatory through-hole may be formed when necessary) by forming a groove or a circular recess by cutting away an outside circumferential surface portion having a predetermined width or diameter of a metal pipe by a press-cutting method, a round-cutting method, or cutting or grinding with a tool. The groove may be formed so as to be perpendicular to, inclined from, or in a certain situation parallel with the center line of the metal pipe. The thickness of the thin portion that is formed on the pipe outside circumferential surface side is determined properly in consideration of the material, thickness, and strength of the metal pipe, the through-hole diameter, the burring wall height, and other factors.

A through-hole having a burring wall may be formed so as to be inclined from the center line of a metal pipe, or may be formed along a line that does not pass through the center line of a metal pipe.

BRIEF DESCRIPTION OF THE DRAWINGS

FIGS. 5(A) and 5(B) are sectional views showing metal pipes having an inclined through-hole according to another embodiment of the first aspect of the invention, in which FIG. 5(A) shows a case where a thin portion is formed by a groove having a rectangular cross-section and FIG. 5(B) shows a case where a thin portion is formed by a groove having an arc-shaped cross-section;

FIG. 27(B) shows a case where a thin portion is formed by a groove having an arc-shaped cross-section;

FIGS. 28(A) and 28(B) are sectional views corresponding to FIG. 22 and showing metal pipes having an eccentric through-hole according to a further embodiment of the third aspect of the invention, in which FIG. 28(A) shows a metal pipe having a cylindrical burring wall on the pipe inside circumferential surface side and FIG. 28(B) shows a metal pipe having a cylindrical burring wall on the pipe outside circumferential surface side.

DETAILED DESCRIPTION OF THE PREFERRED EMBODIMENTS

First, in a first aspect of the present invention shown by FIG. 1 to FIGS. 9(A)–9(B), reference symbols 1 and 1*a*–1*d* denote metal pipes; 2 and 2*a*–2*d,* grooves or recesses formed by removing an outside circumferential surface portion of a metal pipe; 3, a thin portion; 4 and 4*a*–4*d,* through-holes; 5 and 5*a*–5*c,* burring walls; 6, an opening edge; and 7, a punch.

Metal pipes such as a cooling jet pipe for cooling the cylinder or the piston of an engine and a lubrication oil jetting pipe used in, for example, a system for supplying (jetting) a lubricant for a crank shaft or a cam shaft and metal pipes that can be produced by working by the method of the invention are steel pipes that are, for example, 4.0–20 mm in diameter and 0.5–3 mm in thickness (relatively thin) and are made of, for example, STKM. Branch holes of about 0.6–1.0 mm in diameter for, for example, oil jetting nozzles are formed so as to be spaced from each other in the pipe axis direction. When necessary, nozzle pipes or branch pipes are brazed to the inside surfaces of the respective branch holes or are brazed to a metal pipe so as to include the respective branch holes.

Figure 1:
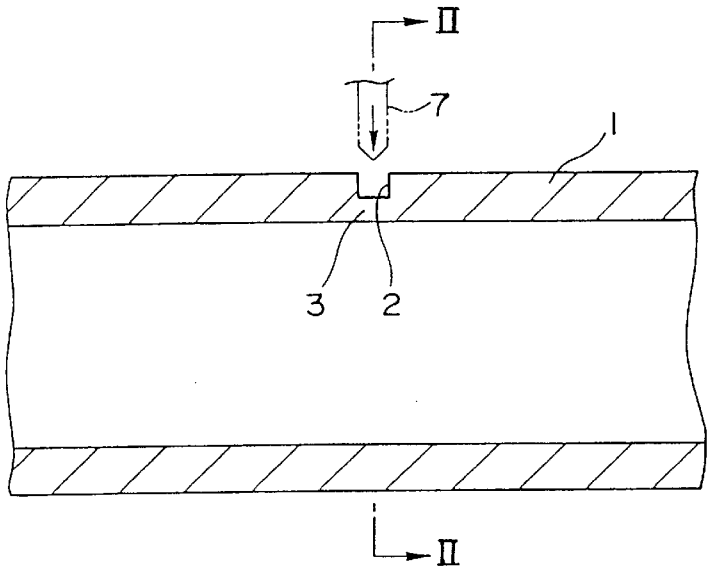
FIG. 1 is a side sectional view of a thin portion formed by cutting away an outside circumferential surface portion of a metal pipe in a first embodiment of a method for forming a through-hole through the circumferential wall of a metal pipe according to a first aspect of the present invention.
Figure 2:
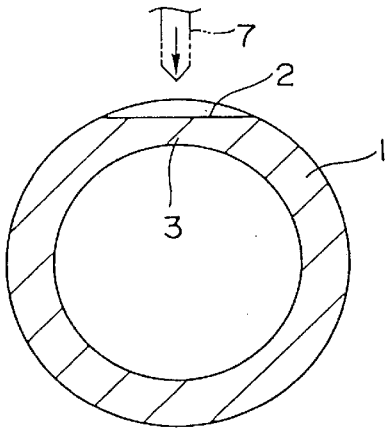
FIG. 2 is a front sectional view taken along line II—II in FIG. 1.

In a method according to a first embodiment of the first aspect of the invention shown by FIGS. 1 and 2, a thin portion 3 is formed by forming a groove 2 whose bottom surface is a flat surface, an arc surface, or an arc surface having a large radius of curvature by removing an outside circumferential surface portion having a predetermined width of a metal pipe 1 by, for example, a press-cutting method in which a blade is moved straightly or a round-cutting method in which a blade performs arc motion. Alternatively, a thin portion 3 is formed by forming a recess 2 having a flat or arc bottom surface by removing an outside circumferential surface portion by a cutting or grinding method in which a small-diameter blade or grindstone is rotated.

It is preferable that the width of the groove 2 or the diameter of the recess 2 be made approximately equal to the diameter of a through-hole 4 to be formed there. The depth of the groove or recess 2 is so set as to avoid formation of a recess (shearing droop) at the opening portion on the pipe outside circumferential surface side when a through-hole 4 is formed by a punch method.

Figure 3:
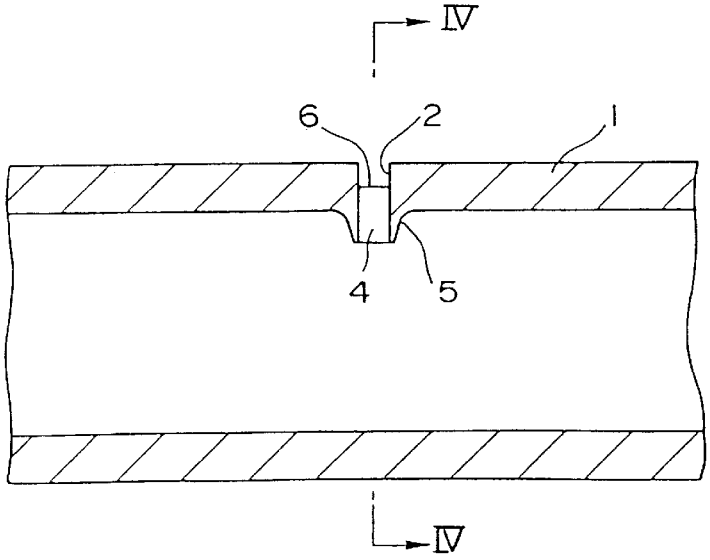
FIG. 3 is a sectional view corresponding to FIG. 1 and shows a metal pipe having a through-hole formed by the method shown by FIGS. 1 and 2.
Figure 4:
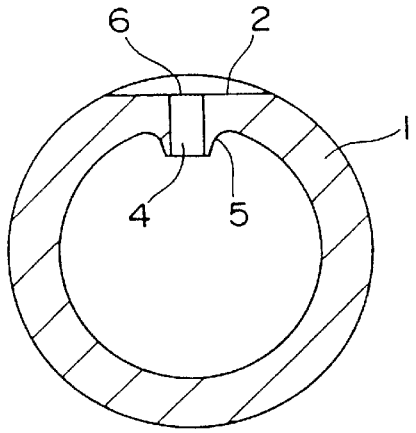
FIG. 4 is a front sectional view taken along line IV—IV in FIG. 3.

Then, a through-hole 4 is formed by pressing the thin portion 3 of the metal pipe 1 inward in the radial direction by a press method using a punch 7 having approximately the same diameter as the width of the groove 2 or the diameter of the recess 2. By pressing the thin portion 3 inward in the radial direction by the press method using the punch 7, as shown in FIGS. 3 and 4, a through-hole 4 is formed in the thin-portion 3 without causing a shearing droop at the opening portion on the pipe outside circumferential surface side and, at the same time, a cylindrical burring wall 5 is formed on the inside circumferential surface of the metal pipe 1 so as to extend in the radial direction. The through-hole 4 thus formed is preferably longer than the thickness of the metal pipe 1 because of the formation of the cylindrical burring wall 5 extending in the radial direction of the metal pipe 1, and an edge 6 is formed at the opening portion on the pipe outside circumferential surface side.

Figure 5A:
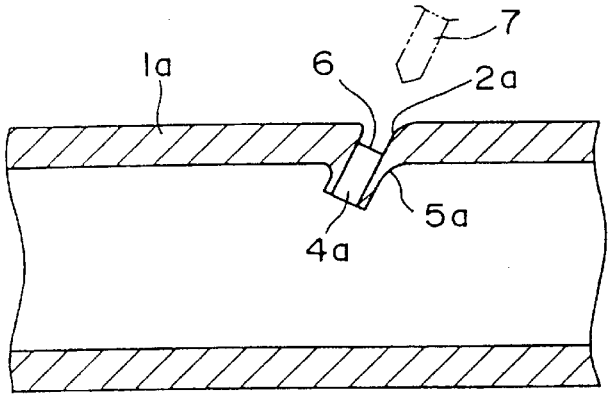
Figure 5B:
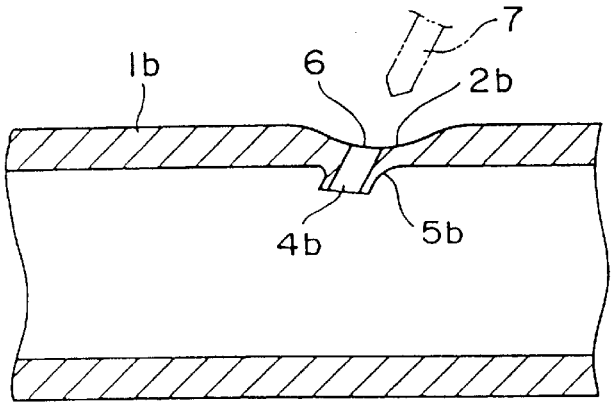

FIGS. 5(A) and 5(B) show a metal pipe according to another embodiment in which a through-hole is formed so as to be inclined from the center line of the metal pipe. Specifically, FIG. 5(A) shows a metal pipe 1*a* in which a through-hole 4*a* having a cylindrical burring wall 5*a* that projects from the pipe inside circumferential surface has been formed by forming a groove or recess 2*a* having a rectangular cross-section in a direction inclined from the center line of the metal pipe 1*a* by removing an outside circumferential surface portion having a predetermined width or diameter of the metal pipe 1*a,* and then pressing a thin portion of the metal pipe 1*a* inward at the same inclination angle as that of the groove or recess 2*a* by a press method using a punch 7 having approximately the same diameter as the groove or recess 2*a*. Similarly, FIG. 5(B) shows a metal pipe 1*b* in which a through-hole 4*b* having a cylindrical burring wall 5*b* that projects from the pipe inside circumferential surface has been formed by forming a groove 2*b* having an arc-shaped cross-section by removing an outside circumferential surface portion having a predetermined width of the metal pipe 1*b,* and then pressing a thin portion formed by the groove 2*b* inward in a direction inclined from the center line of the metal pipe 1*b* by a press method using a punch 7. As in the case of FIGS. 4 and 5, the through-holes 4*a* and 4*b* of the respective metal pipes 1*a* and 1*b* shown in FIGS. 5(A) and 5(B) are preferably longer than the thickness of the respective metal pipes 1*a* and 1*b* because of the formation of the cylindrical burring walls 5*a* and 5*b* extending from the inside surfaces of the respective metal pipes 1*a* and 1*b,* and edges 6 are formed at the opening portions on the pipe outside circumferential surface side.

Figure 6:
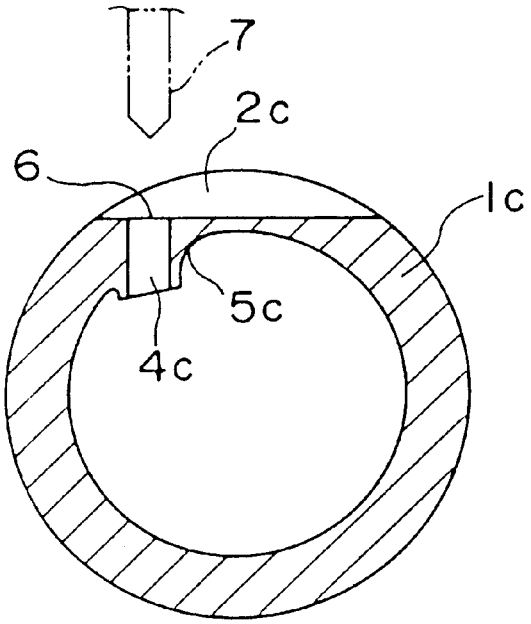
FIG. 6 is a sectional view corresponding to FIG. 4 and shows a metal pipe having an eccentric through-hole according to another embodiment of the first aspect of the invention.

FIG. 6 shows a metal pipe according to another embodiment in which an eccentric through-hole is formed. Specifically, FIG. 6 shows a metal pipe 1*c* in which a through-hole 4*c* having a cylindrical burring wall 5*c* that projects from the pipe inside circumferential surface has been formed by forming a groove or recess 2*c* having a flat bottom surface along a line that is deviated from the center line of the metal pipe 1*c* by a predetermined distance by removing an outside circumferential surface portion of the metal pipe 1*c,* and then pressing a thin portion of the metal pipe 1*c* inward along a line that does not pass through the center line of the metal pipe 1*c* by a press method using a punch 7 having approximately the same diameter as the groove or recess 2*c*. As in the above embodiments, the eccentric through-hole 4*c* of the metal pipe 1*c* is preferably longer than the thickness of the metal pipe 1*c* because of the formation of the cylindrical burring wall 5*c* extending from the inside circumferential surface of the metal pipe 1*c,* and an edge 6 is formed at the opening portion on the pipe outside circumferential surface side.

Figure 7:
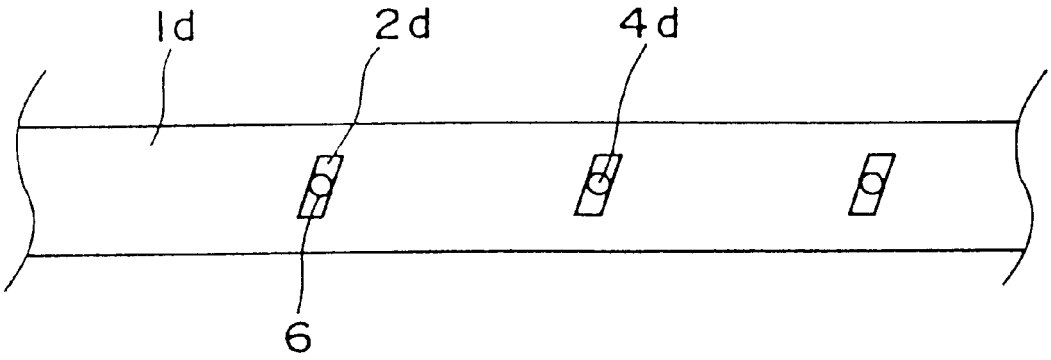
FIG. 7 is a plan view of a metal pipe according to still another embodiment of the first aspect of the invention.

In the above embodiments, when the thin portion is formed by a groove, each of the grooves 2 and 2*a*–2*c* is formed by removing an outside circumferential surface portion in the direction perpendicular to the center line of each of the metal pipes 1 and 1*a*–1*c*. FIG. 7 shows an alternative structure in which a groove 2*d* is formed so as to be inclined from, or in a certain situation parallel with, the center line of a metal pipe 1*d*. Then, as in the above embodiments, a through-hole 4*d* having a cylindrical burring wall that extends from the pipe inside circumferential surface is formed by pressing the thin portion inward by a press method using a punch having approximately the same diameter as the width of the groove 2*d*. As in the above embodiments, the through-hole 4*d* thus formed is preferably longer than the thickness of the metal pipe 1*d* because of the formation of the cylindrical burring wall extending from the pipe inside circumferential surface of the metal pipe 1*d,* and an edge 6 is formed at the opening portion on the pipe outside circumferential surface side.

By using the through-holes 4 and 4*a*–4*d* as branch holes for nozzles, the metal pipes 1 and 1*a*–1*d* formed with the through-holes 4 and 4*a* –4*d* can be used as they are as, for example, a cooling oil jet pipe for cooling the cylinder or the piston of an engine or a lubrication oil jet pipe that is used in a system for supplying (jetting) a lubricant to a sliding portion such as a crank shaft or a cam shaft. If necessary, nozzle pipes may be connected to the through-holes to change the oil jetting direction or make the jetting outlets closer to an object or branch pipes for general piping may be connected to the through-holes.

Figure 8A:
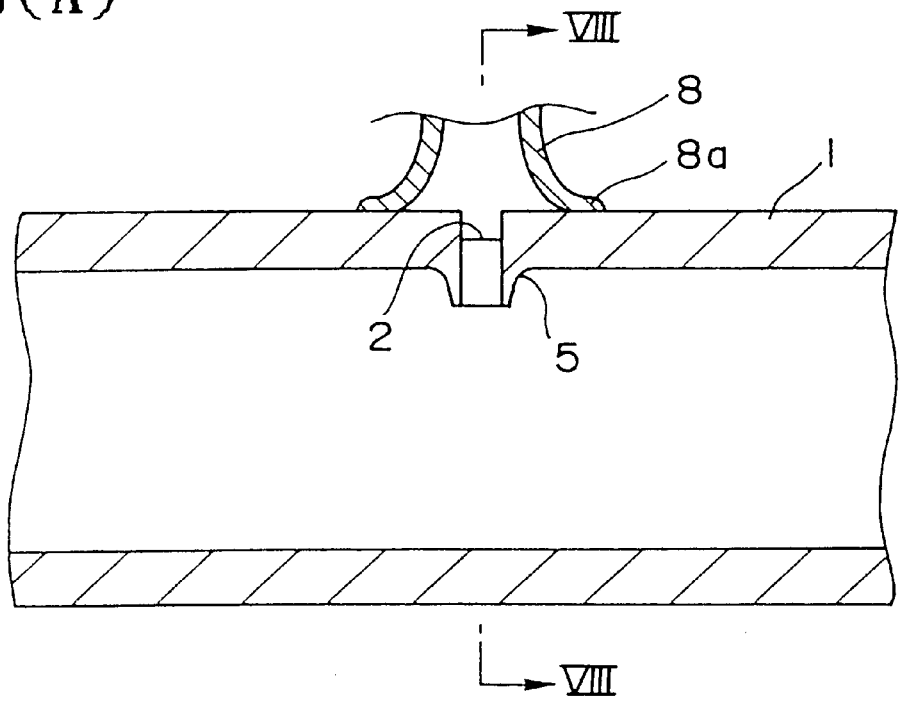
FIG. 8(A) is a side sectional view showing the main part of a metal pipe according to a further embodiment of the first aspect of the invention.
Figure 8B:
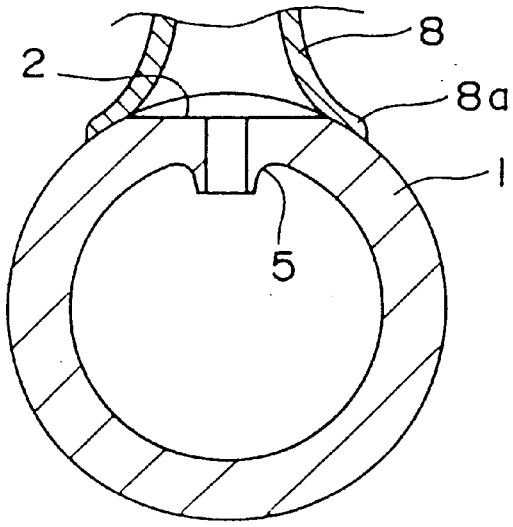
FIG. 8(B) is a sectional view taken along line VIII—VIII in FIG. 8(A)

That is, as shown in FIGS. 8(A) and 8(B), an end portion 8*a* of a nozzle pipe 8 that is enlarged to assume a funnel shape so that the diameter becomes larger than the length or diameter of the groove or recess 2 is brazed to the outside circumferential surface of the metal pipe 1 so as to include the groove or recess 2. As a result, in addition to the advantage of the burring wall 5, an advantage is obtained that high brazing strength can be secured because the area of brazing between the funnel-shaped end portion 8*a* and the outside circumferential surface of the metal pipe 1 is increased.

Figure 9A:
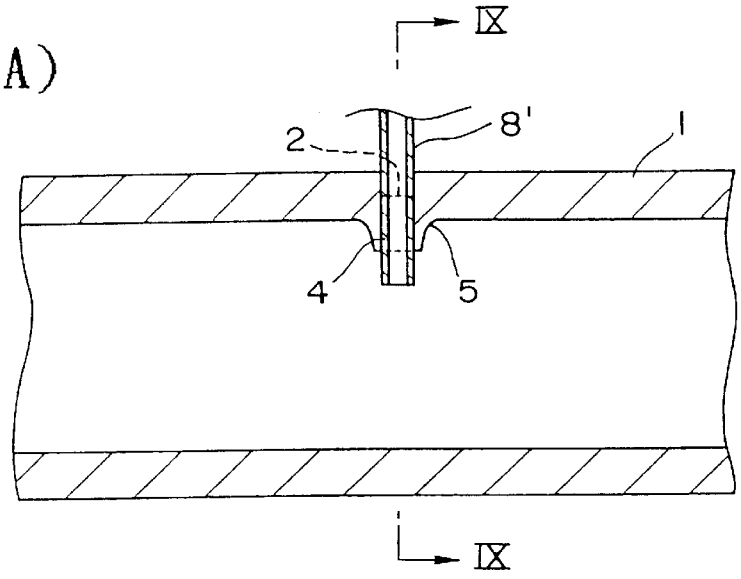
FIG. 9(A) is a side sectional view showing the main part of a metal pipe according to another embodiment of the first aspect of the invention.
Figure 9B:
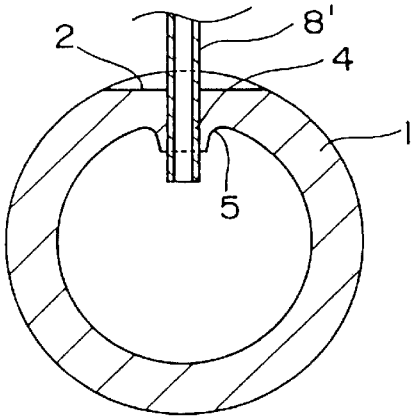
FIG. 9(B) is a sectional view taken along line IX—IX in FIG. 9(A)

FIGS. 9(A) and 9(B) show another embodiment in which one end portion of a nozzle pipe 8' having approximately the same outer diameter as the inner diameter of the through-hole 4 is inserted through the through-hole 4 and brazed to the inside surface of the burring wall 5. This structure can not only secure sufficient brazing strength by increasing the brazing area but also improve the jetting directivity.

Next, a method for forming a through-hole through the circumferential wall of a metal pipe according to a second aspect of the invention will be described with reference to FIGS. 10–18.

In FIGS. 10–18, reference symbols 11 and 11*a*–11*c* denote metal pipes; 12, an elliptical, circular, or rectangular preparatory hole formed by removing an outside circumferential surface portion of a metal pipe with an arc-shaped blade, a round blade, or a flat blade; 13 and 13*a*–13*c,* through-holes; 14 and 14*a* –14*b,* burring walls; 15, a punch; and 16, an edge.

Metal pipes used in this aspect of the invention have basically the same shape and structure and are made of basically the same material as the metal pipes described in the first aspect of the invention.

Figure 10:
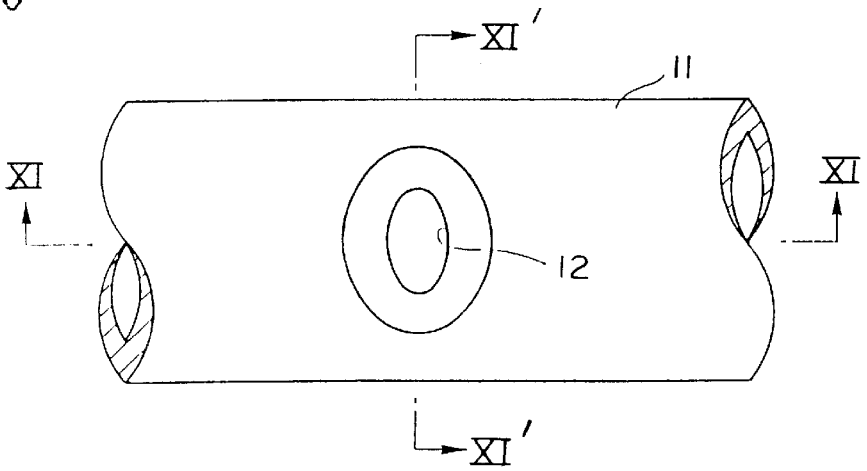
FIG. 10 is a plan view of a through-hole portion formed by removing an outside circumferential surface portion of a metal pipe in a first embodiment of a method for forming a through-hole through the circumferential wall of a metal pipe according to a second aspect of the present invention.
Figure 11A:
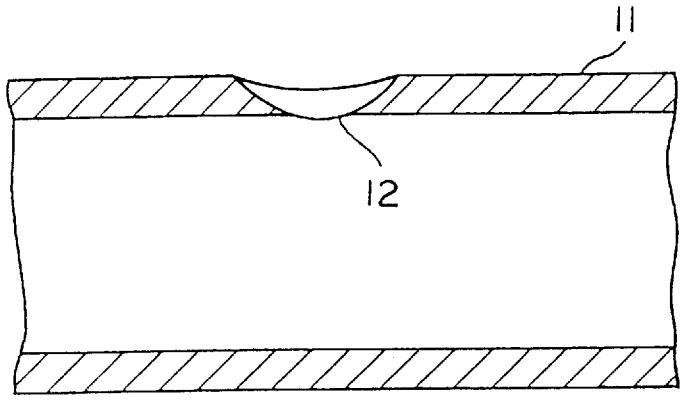
FIG. 11(A) is a sectional view taken along line XI—XI in FIG. 10.
Figure 11B:
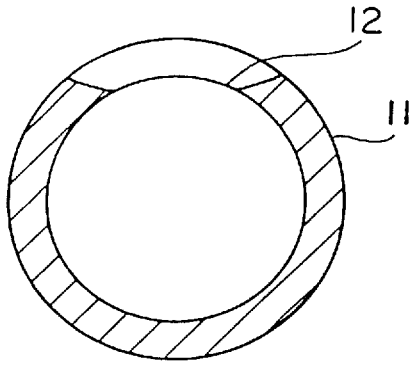
FIG. 11(B) is a sectional view taken along line XI'—XI' in FIG. 10.
Figure 12:
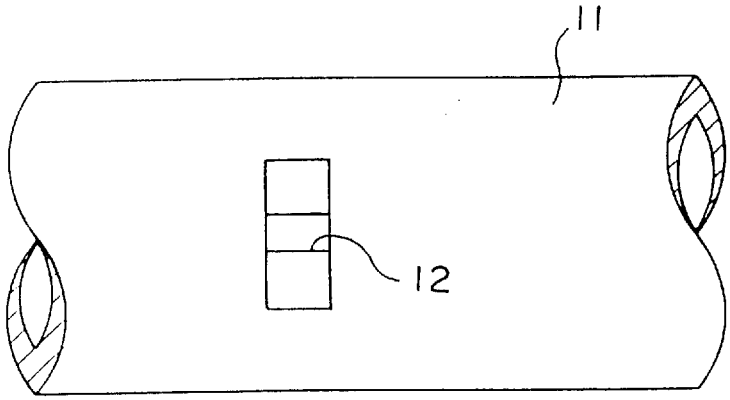
FIG. 12 is a plan view showing a through-hole portion having a different shape than shown in FIG. 10.

In a method according to a first embodiment of the second aspect of the invention, first, as shown in FIG. 10 and FIGS. 11(A) and 11(B), an elliptical preparatory hole 12 is formed by removing an outside circumferential surface portion of a metal pipe 11 by, for example, a press-cutting method in which an arc-shaped blade is moved straightly or a cutting or grinding method in which a grindstone is rotated. Alternatively, as shown in FIG. 12, a rectangular preparatory hole 12 is formed by, for example, a press-cutting method in which a flat blade is moved straightly or a cutting or grinding method. The preparatory hole 12 can be given a desired shape by using a proper blade and a proper removing method. A slight thin portion is formed around the thus-formed preparatory hole 12. The size of the preparatory hole 12 is set in accordance with the diameter of the metal pipe 11 so as to avoid formation of a recess (shearing droop) at the opening portion on the pipe outside surface side.

Figure 13:
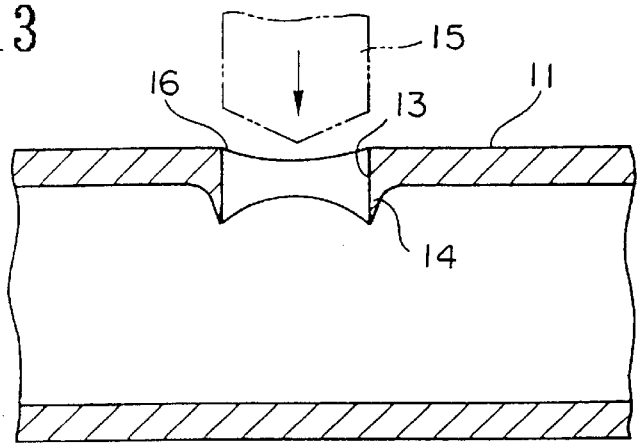
FIG. 13 is a sectional view corresponding to FIG. 11(A) and shows a metal pipe having a through-hole with a burring wall that has been formed by the method shown by FIGS. 10 and 11(A)–11(B)

Then, the preparatory hole 12 portion of the metal pipe 11 is pressed inward in the radial direction by a press method using a punch 15 having a larger diameter than the size of the preparatory hole 12 that is formed on the outside circumferential surface side of the metal pipe 11. By pressing the preparatory hole 12 portion inward in the radial direction by the press method using the punch 15, a cylindrical burring wall 14 is formed so as to extend in the radial direction from the inside circumferential surface of the metal pipe 11 as shown in FIG. 13. A through-hole 13 thus formed does not cause a shearing droop at the opening portion on the pipe outside circumferential surface side, and is preferably longer than the thickness of the metal pipe 11 because of the formation of the cylindrical burring wall 15 extending in the radial direction of the metal pipe 1. Further, an edge 16 is formed at the opening portion on the pipe outside circumferential surface side.

The thus-formed through-hole 13 having the cylindrical burring wall 14 can be used, as it is, as a branch hole for a nozzle. However, the through-hole 13 has a relatively large diameter because it is formed by removing an outside circumferential surface portion of the metal pipe 11.

Figure 14:
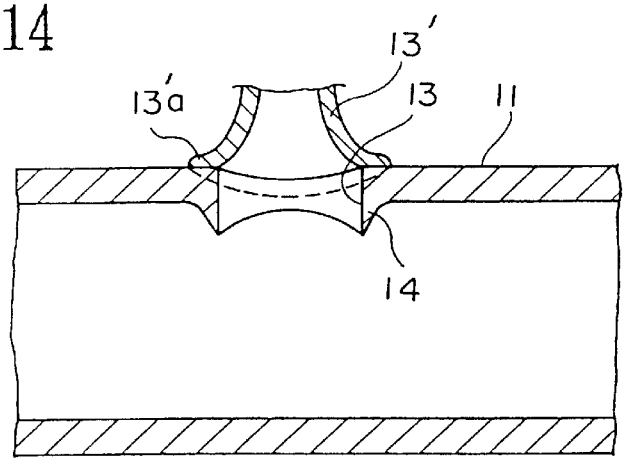
FIG. 14 is a sectional view corresponding to FIG. 13 and shows a metal pipe to which a nozzle pipe is brazed to a through-hole having a burring wall.

Therefore, if necessary, as shown in FIG. 14, an end portion 13' of a nozzle pipe 13 that is enlarged to assume a funnel-like and saddle-like shape so that the diameter becomes larger than the length or diameter of the through-hole 13 is brazed to the outside circumferential surface of the metal pipe 11 so as to include the outside end of the through-hole 13. As a result, in addition to the advantage of the burring wall 14, an advantage is obtained that high brazing strength can be secured because the area of brazing between the funnel-shaped end portion 13' and the outside circumferential surface of the metal pipe 11 is increased.

Figure 15:
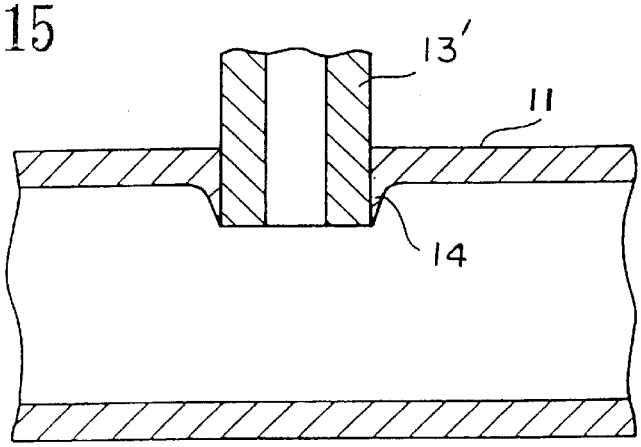
FIG. 15 is a sectional view corresponding to FIG. 13 and shows another metal pipe to which a nozzle pipe is brazed to a through hole having a burring wall.

Alternatively, as shown in FIG. 15, one end portion of a nozzle pipe 13' having approximately the same outer diameter as the inner diameter of the through-hole 13 may be inserted through the through-hole 13 and brazed thereto as well as to the inside surface of the burring wall 14. This structure can not only secure sufficient brazing strength because the brazing area is increased by the cylindrical burring wall 14, but also improve the jetting directivity.

Figure 16:
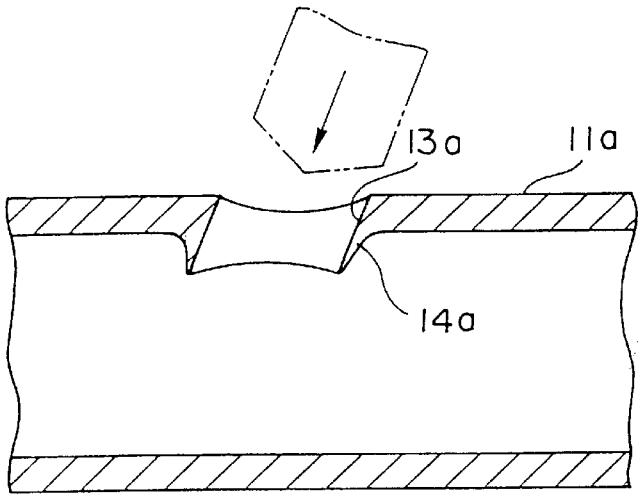
FIG. 16 is a sectional view corresponding to FIG. 13 and shows a metal pipe having an inclined through-hole according to another embodiment of the second aspect of the invention.

FIG. 16 shows a metal pipe according to another embodiment in which a through-hole is formed so as to be inclined from the center line of the metal pipe. Specifically, FIG. 16 shows a metal pipe 11*a* in which a through-hole 13*a* having a cylindrical burring wall 14*a* that projects from the pipe inside circumferential surface has been formed by forming a preparatory hole 12 in a direction inclined from the center line of the metal pipe that by removing an outside circumferential surface portion of the metal pipe 11*a,* and then pressing the preparatory hole 12 portion of the metal pipe 11*a* inward at a predetermined inclination angle by a press method using a punch 7 having a larger diameter than the preparatory hole 12. As in the case of the above embodiments, the inclined through-hole 13*a* is preferably longer than the thickness of the metal pipe 11*a* because of the formation of the cylindrical burring wall 14*a* extending from the inside surface of the metal pipe 11*a,* and an edge 16 is formed at the opening portion on the pipe outside circumferential surface side.

Figure 17:
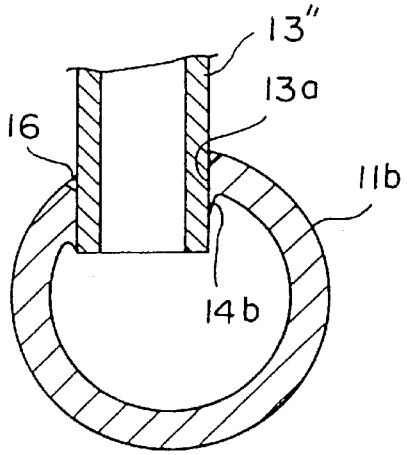
FIG. 17 is a sectional view corresponding to FIG. 13 and shows a metal pipe having an eccentric through-hole according to another embodiment of the second aspect of the invention.

FIG. 17 shows a metal pipe according to another embodiment in which an eccentric through-hole is formed. Specifically, FIG. 17 shows a metal pipe 11*b* in which a through-hole 13*b* having a cylindrical burring wall 14*b* that projects from the pipe inside circumferential surface has been formed by forming a preparatory hole 12 along a line that is deviated from the center line of the metal pipe 11*b* by a predetermined distance by removing an outside circumferential surface portion of the metal pipe 11*b,* and then pressing the preparatory hole 12 portion of the metal pipe 11*b* inward along a line that does not pass through the center line of the metal pipe 11*b* by a press method using a punch 15 having a larger diameter than the preparatory hole 12. One end portion of a nozzle pipe 13" is inserted through the through-hole 13*b* and brazed thereto as well as to the inside surface of the burring wall 14*b*. As in the above embodiments, the eccentric through-hole 13*b* of the metal pipe 11*b* is preferably longer than the thickness of the metal pipe 11*b* because of the formation of the cylindrical burring wall 14*b* extending from the inside circumferential surface of the metal pipe 11*b,* and an edge 16 is formed at the opening portion on the pipe outside circumferential surface side.

Figure 18:
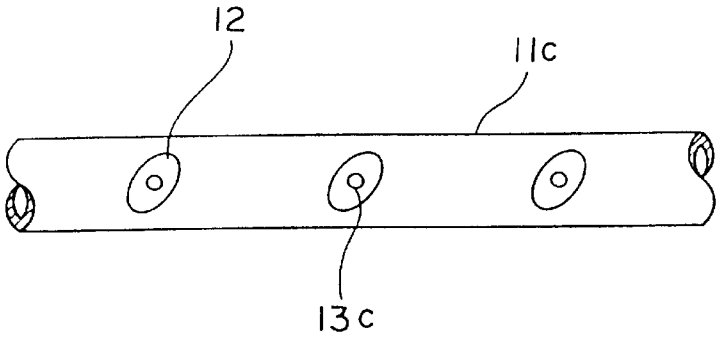
FIG. 18 is a plan view of a metal pipe according to still another embodiment of the second aspect of the invention in which a through-hole portion is formed in a direction inclined from the axial line of the metal pipe by removing an outside circumferential surface portion of the metal pipe.

In the above embodiments of the second aspect of the invention, when the through-hole is formed removing an outside circumferential surface portion of the metal pipe, the preparatory hole 12 is formed by removing the outside circumferential surface portion in the direction perpendicular to the center line of the metal pipe. FIG. 18 shows an alternative structure in which a preparatory hole 12 is formed so as to be inclined from, or in a certain situation parallel with, the center line of a metal pipe 11*c*. Then, as in the above embodiments, a through-hole 13*c* having a cylindrical burring wall that extends from the pipe inside circumferential surface is formed by pressing the preparatory hole 12 portion inward by a press method using a punch 15 having a larger diameter than the preparatory hole 12. As in the above embodiments, the through-hole 13*c* of the metal pipe 11*c* thus formed is preferably longer than the thickness of the metal pipe 13*c* because of the formation of the cylindrical burring wall extending from the inside circumferential surface of the metal pipe 11*c,* and an edge 16 is formed at the opening portion on the pipe outside circumferential surface side.

By using the through-holes 13 and 13*a*–13*c* as branch holes for nozzles, the metal pipes 11 and 11*a*–11*c* formed with the through-holes 13 and 13*a*–13*c* can be used as they are as, for example, a cooling oil jet pipe for cooling the cylinder or the piston of an engine or a lubrication oil jet pipe that is used in a system for supplying (jetting) a lubricant to a sliding portion such as a crank shaft or a cam shaft. If necessary, nozzle pipes may be connected to the through-holes to change the oil jetting direction or make the jetting outlets closer to an object or branch pipes for general piping may be connected to the through-holes.

Next, a method for forming a through-hole through the circumferential wall of a metal pipe according to a third aspect of the invention will be described with reference to FIGS. 19–29. In FIGS. 19–29, reference symbols 21 and 12*a*–21*h* denote metal pipes; 22 and 22*a*–22*h,* grooves or recesses formed by removing an outside circumferential surface portion of a metal pipe; 23, a thin portion; 24 and 24*a*–24*h,* through-holes; 25 and 25*a*–25*f,* burring walls; 26, an opening edge; 27, an outside cylinder jig; 28, a liquid; 29 and 31, hole-forming jigs; and 30, a sphere.

Metal pipes used in this aspect of the invention have basically the same shape and structure and are made of basically the same material as the metal pipes described in the first and second aspects of the invention.

Figure 19:
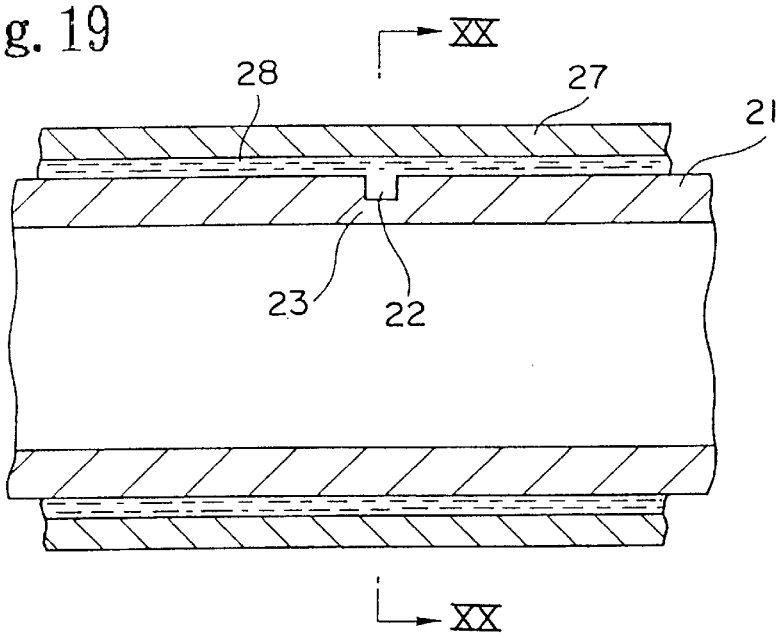
FIG. 19 is a side sectional view showing a first embodiment of a method for forming a through-hole through the circumferential wall of a metal pipe according to a third aspect of the invention, more specifically, showing a thin portion formed by a method in which a through-hole is formed in the thin portion that has been formed by removing an outside circumferential surface portion of a metal pipe, by applying fluid pressure to the thin portion from outside and a cylindrical burring wall is thereby formed on the inside circumferential surface side of the metal pipe.
Figure 20:
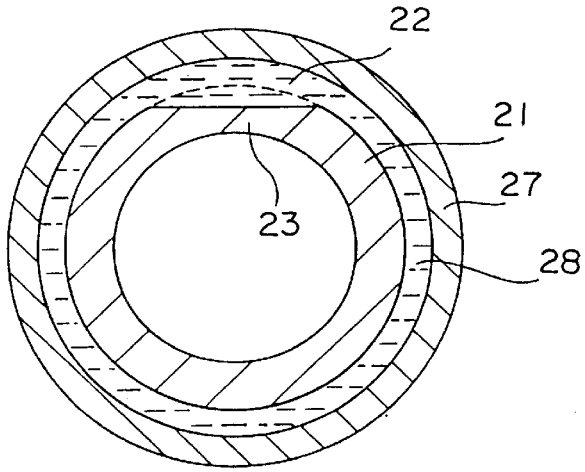
FIG. 20 is a sectional view taken along line XX—XX in FIG. 19.

In a method according to an embodiment of the third aspect of the invention shown by FIGS. 19 and 20, a thin portion 23 is formed by forming a groove 22 whose bottom surface is a flat surface, an arc surface, or an arc surface having a large radius of curvature by removing an outside circumferential surface portion having a predetermined width of a metal pipe 21 by, for example, a press-cutting method in which a blade is moved straightly or a round-cutting method in which a blade performs arc motion. Alternatively, a thin-portion 23 is formed by forming a recess 22 having a flat or arc bottom surface by removing an outside circumferential surface portion by a cutting or grinding method in which a small-diameter blade or grindstone is rotated.

It is preferable that the width of the groove 22 or the diameter of recess 22 be made approximately equal to the diameter of a through-hole 24 to be formed there. The depth of the groove or recess 22 is so set as to avoid formation of a recess (shearing droop) at the opening portion on the pipe outside circumferential surface side when a through-hole 24 is formed by fluid pressure.

Then, after an outside cylinder jig 27 is fitted to the outside circumferential surface of the metal pipe 21 so as to establish a sealing condition, a liquid 28 is introduced into the space between the metal pipe 21 and the outside cylinder jig 27 to impart fluid pressure. The fluid pressure causes pressing force that is directed inward in the radial direction and hence acts on the thin portion 23. As a result, a through-hole 24 is formed in the thin portion 23 without causing a large shearing droop at the opening portion on the pipe outside circumferential surface side and, at the same time, a cylindrical burring wall 25 is formed so as to extend radially from the inside circumferential surface of the metal pipe 21. The metal pipe 21 assumes basically the same shape as the metal pipe 1 according to the first aspect of the invention shown in FIGS. 3 and 4. The through-hole 24 thus formed is preferably longer than the thickness of the metal pipe 21 because of the formation of the cylindrical burring wall 25 extending in the radial direction of the metal pipe 21, and an edge 26 is formed at the opening portion on the pipe outside circumferential surface side.

Figure 21:
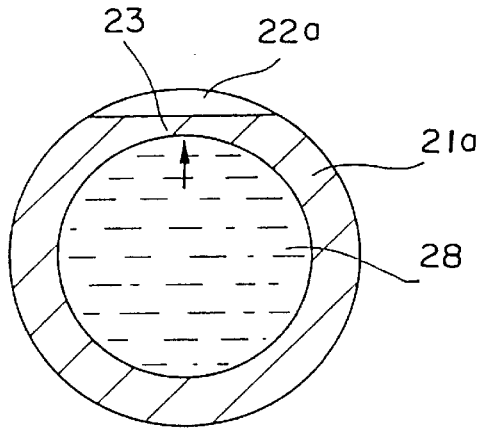
FIG. 21 is a sectional view corresponding to FIG. 20 and shows another embodiment of the third aspect of the invention, more specifically, a method in which a through-hole is formed in a thin portion that has been formed by removing an outside circumferential surface portion of a metal pipe, by applying fluid pressure to the thin portion from inside and a cylindrical burring wall is thereby formed on the outside circumferential surface side of the metal pipe.
Figure 22:
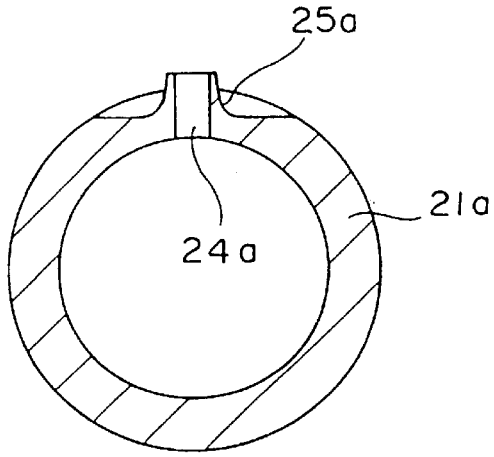
FIG. 22 is a sectional view showing a metal pipe having a through-hole formed by the method of FIG. 21.

FIG. 21 shows another method in which a thin portion 23 is formed by forming a groove 22*a* or a recess that is the same as in the above embodiment by removing an outside circumferential surface portion of a metal pipe 21*a,* and then a through-hole having a cylindrical burring wall on the outside circumferential surface side of the metal pipe 21*a* is formed by applying fluid pressure to the thin portion 23 from inside, that is, in the direction opposite to the direction in the method of FIGS. 19 and 20. Specifically, a through-hole 24*a* having a cylindrical burring wall 25*a* on the outside circumferential surface side of the metal pipe 21*a* is formed in the thin portion 23 of the metal pipe 21*a* (see FIG. 22) by applying desired liquid pressure to the thin portion 23 by introducing a liquid 28 into the metal pipe 21*a* from its one end in a state that both end portions of the metal pipe 21*a* are sealed. As in the above embodiment, the through-hole 24*a* thus formed is preferably longer than the thickness of the metal pipe 21*a* because of the formation of the cylindrical burring wall 25*a* extending in the radial direction of the metal pipe 21.

FIG. 19–21 exemplify the method in which a through-hole having a cylindrical burring wall is formed by applying fluid pressure to a thin portion that has been formed by removing an outside circumferential surface portion of a metal pipe. Another method will be described below in which a through-hole having a cylindrical burring wall is formed by using a sphere rather than fluid pressure.

Figure 23:
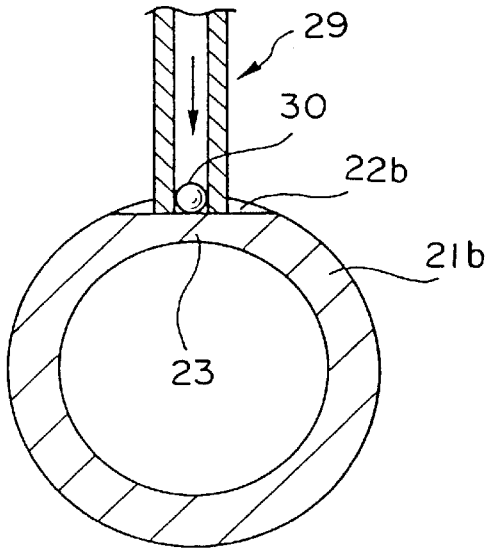
FIG. 23 is a sectional view corresponding to FIG. 20 and shows another embodiment of the third aspect of the invention, more specifically, a method in which a through-hole is formed in a thin portion that has been formed by removing an outside circumferential surface portion of a metal pipe, by pressing the thin portion from outside with a sphere and a cylindrical burring wall is thereby formed on the inside circumferential surface side of the metal pipe.
Figure 24:
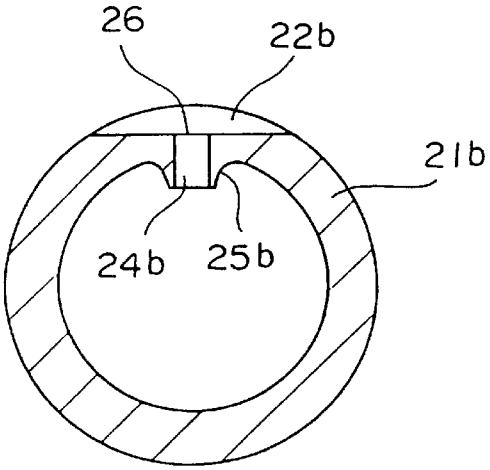
FIG. 24 is a sectional view corresponding to FIG. 22 and shows a metal pipe having a through-hole formed by the method of FIG. 23.

FIGS. 23 and 24 show an embodiment of such a method. Specifically, a through-hole 24*b* having a cylindrical burring wall 25*b* that extends radially from the pipe inside circumferential surface is formed by applying desired pressure to a sphere 30 by supplying pressurized fluid such as compressed air or pressurized oil or water to a hole-forming jig 29 in a state that the hole-forming jig 29 in which the sphere 30 is inserted is attached, from outside, to a thin portion 23 that has been formed by forming a groove 22*b* or recess that is the same as in the above embodiment by removing an outside circumferential surface portion of a metal pipe 21*b*. As in the case of the metal pipe 1 shown in FIGS. 3 and 4, the through-hole 24*b* thus formed is preferably longer than the thickness of the metal pipe 21*b* because of the formation of the cylindrical burring wall 25*b* extending in the radial direction of the metal pipe 21*b,* and an edge 26 is formed at the opening portion on the pipe outside circumferential surface side.

Figure 25:
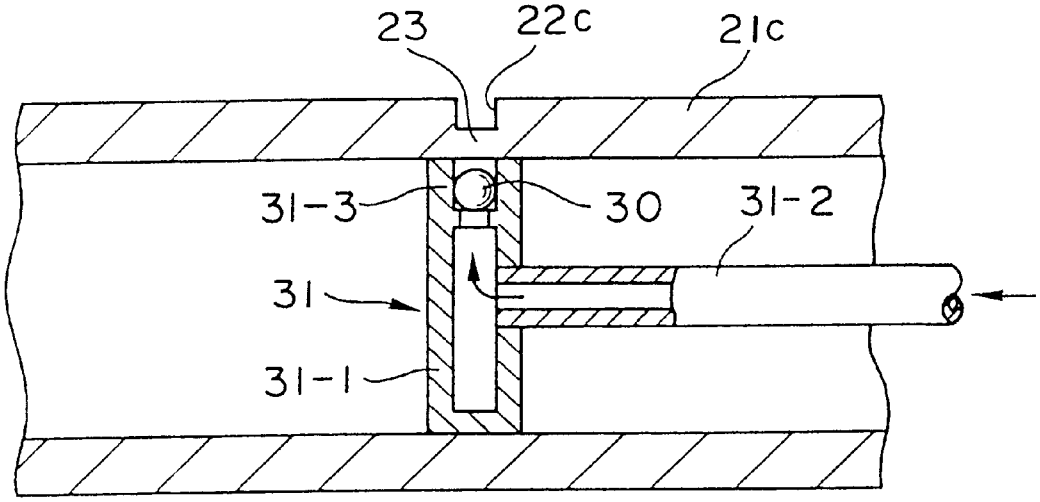
FIG. 25 is a sectional view corresponding to FIG. 19 and shows still another embodiment of the third aspect of the invention, more specifically, a method in which a through-hole is formed in a thin portion that has been formed by removing an outside circumferential surface portion of a metal pipe, by pressing the thin portion from inside with a sphere and a cylindrical burring wall is thereby formed on the outside circumferential surface side of the metal pipe.
Figure 26:
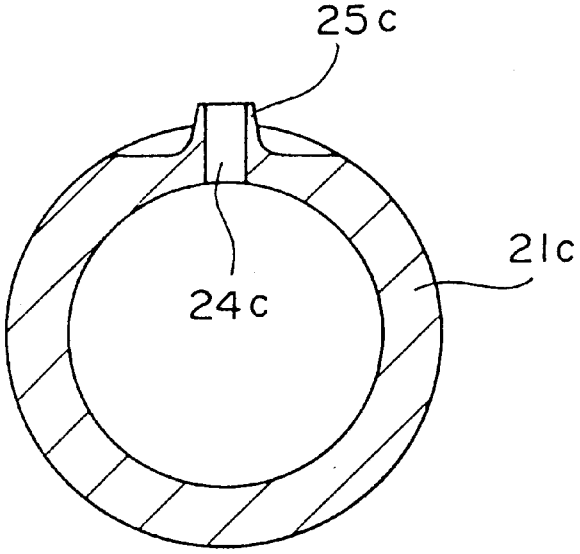
FIG. 26 is a sectional view corresponding to FIG. 22 and shows a metal pipe having a through-hole formed by the method of FIG. 25.

FIGS. 25 and 26 show a method in which a through-hole having a cylindrical burring wall on the outside circumferential surface side of a metal pipe is formed by pressing, from inside (i.e., in the direction opposite to the direction in the method of FIGS. 23 and 24), with a sphere, a thin portion that has been formed by removing an outside circumferential surface portion of the metal pipe. Specifically, a hole-forming jig 31 that is composed of a disc 31–1 being slidable in the internal space of a metal pipe 21*c* and a liquid supply pipe 31–2 and that is so configured as to apply pressing force to a sphere 30 that is inserted in a guide cylinder 31–3 of the disc 31–1 in the radial direction via pressurized fluid that is supplied from the fluid supply pipe 31–2 is inserted into the metal pipe 21*c* and fixed at a position where the guide cylinder 31–3 is opposed to the thin portion 23 from inside. In this state, a through-hole 24*c* having a cylindrical burring wall 25*c* that extends radially from the outside circumferential surface of the metal pipe 21*c* is formed by applying radial pressing force to the sphere 30 by supplying pressurized fluid to the disc 31–1 from the fluid supply pipe 31–2. As in the case of the metal pipe 21*a* shown in FIG. 22, the through-hole 24*c* thus formed is preferably longer than the thickness of the metal pipe 21*c* because of the formation of the cylindrical burring wall 25*c* extending in the radial direction of the metal pipe 21*b*.

Figure 27A:
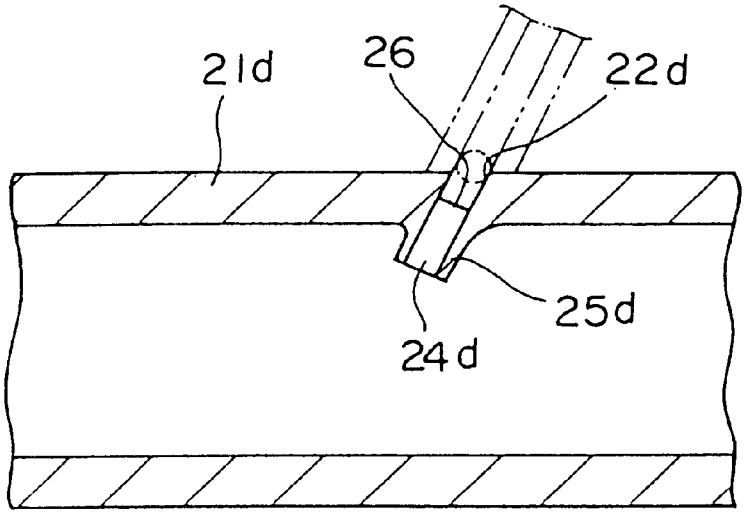
FIGS. 27(A) and 27(B) are sectional views corresponding to FIG. 19 and showing metal pipes having an inclined through-hole, in which FIG. 27 (A) shows a case where a thin portion is formed by a groove having a rectangular cross-section
Figure 27B:
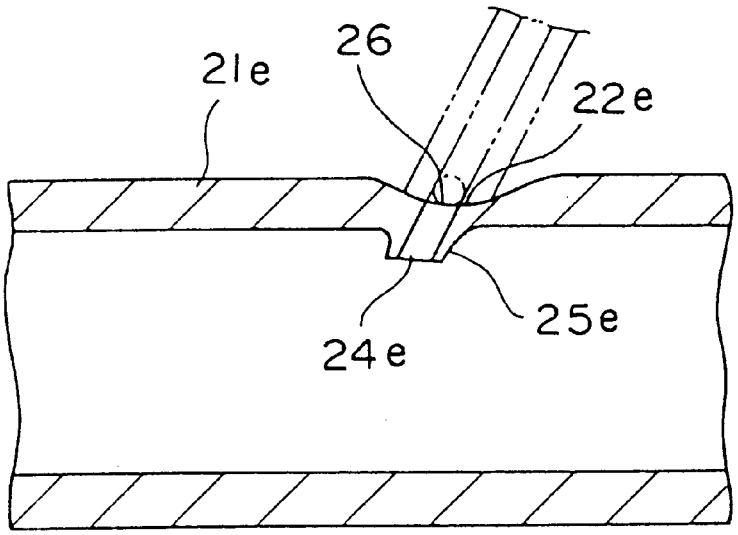

FIGS. 27(A) and 27(B) show a metal pipe according to a further embodiment in which a through-hole is formed so as to be inclined from the center line of the metal pipe. Specifically, FIG. 27(A) shows a metal pipe 21*d* in which a through-hole 24*a* having a cylindrical burring wall 25*d* that projects from the pipe inside circumferential surface has been formed by forming a groove or recess 22*d* having a rectangular cross-section in a direction inclined from the center line of the metal pipe 21*d* by removing an outside circumferential surface portion having a predetermined width or diameter of the metal pipe 21*d,* and then pressing a thin portion of the metal pipe 21*d* formed by the groove or recess 22*d* inward at the same inclination angle as that of the groove or recess 22*d* by, for example, the method of FIG. 23. Similarly, FIG. 27(B) shows a metal pipe 21*e* in which a through-hole 24*e* having a cylindrical burring wall 25*e* that projects from the pipe inside circumferential surface has been formed by forming a groove 22*e* having an arc-shaped cross-section by removing an outside circumferential surface portion having a predetermined width of the metal pipe 21*e,* and then pressing a thin portion formed by the groove 21*e* inward in a direction inclined from the center line of the metal pipe 1*b* by, for example, the same method as in the case of FIG. 27(A). As in the above embodiments, the through-holes 24*d* and 24*e* of the respective metal pipes 21*d* and 21*e* shown in FIGS. 27(A) and 27(B) are preferably longer than the thickness of the respective metal pipes 21*d* and 21*e* because of the formation of the cylindrical burring walls 25*d* and 25*e* extending from the inside surfaces of the respective metal pipes 21*d* and 21*e,* and edges 26 are formed at the opening portions on the pipe outside circumferential surface side.

Figure 28A:
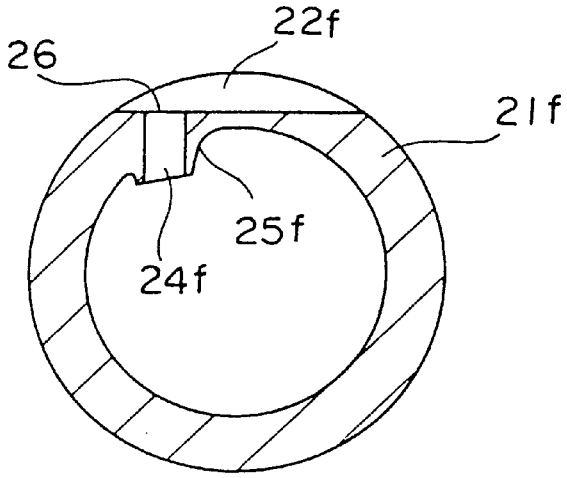
Figure 28B:
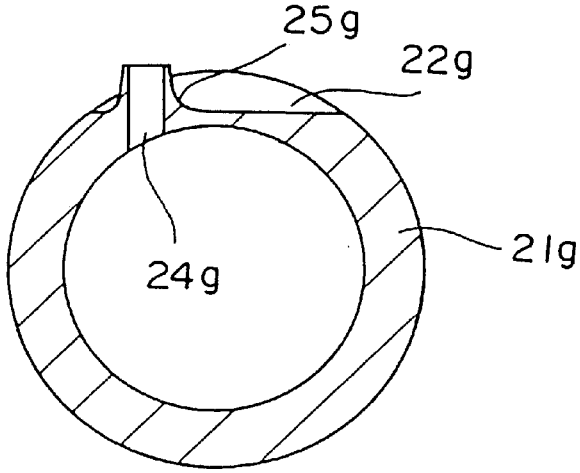

FIGS. 28(A) and 28(B) show metal pipes according to another embodiment in which an eccentric through-hole is formed. Specifically, FIG. 28(A) shows a metal pipe 21*f* in which a through-hole 24*f* having a cylindrical burring wall 25*f* that projects from the pipe inside circumferential surface has been formed by forming a groove or recess 22*f* having a flat bottom surface along a line that is deviated from the center line of the metal pipe 21*f* by a predetermined distance by removing an outside circumferential surface portion of the metal pipe 21*f,* and then pressing a thin portion formed by the groove or recess 22*f* inward along a line that does not pass through the center line of the metal pipe 21*f* by, for example, the method of FIG. 23. Similarly, FIG. 28(B) shows a metal pipe 21*g* in which a through-hole 24*g* having a cylindrical burring wall 25*g* that projects from the pipe outside circumferential surface has been formed by forming a groove or recess 22*g* having a flat bottom surface along a line that is deviated from the center line of the metal pipe 21*g* by a predetermined distance by removing an outside circumferential surface portion of the metal pipe 21g, and then pressing a thin portion formed by the groove or recess 22*g* outward along a line that does not pass through the center line of the metal pipe 21*g* by, for example, the method of FIG. 25. As in the above embodiments, the through-holes 24*f* and 24*g* of the respective metal pipes 21*f* and 21*g* are preferably longer than the thickness of the respective metal pipes 21*f* and 21*g* because of the formation of the cylindrical burring walls 25*f* and 25*g* extending from the inside circumferential surface of the metal pipe 1*c,* and an edge 26 is formed at the opening portion of the metal pipe 21*f* on the outside circumferential surface side.

Figure 29:
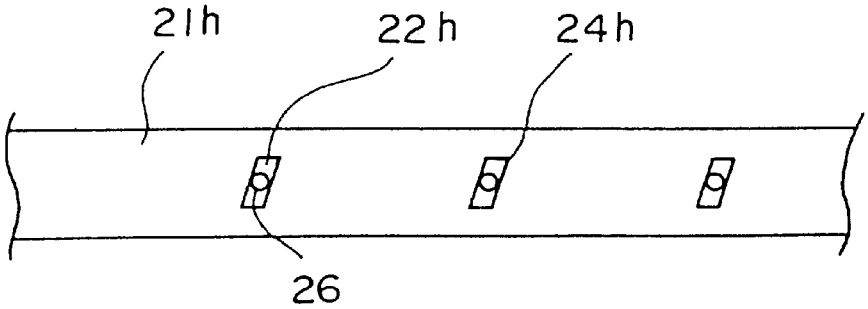
FIG. 29 is a plan view of a metal pipe according to another embodiment of the third aspect of the invention.

In the above embodiments of the third aspect of the invention, when the thin portion is formed by a groove, each of the grooves 22 and 22*a*–22*g* is formed by removing an outside circumferential surface portion in the direction perpendicular to the center line of each of the metal pipes 21 and 21*a*–21*g*. FIG. 29 shows an alternative structure in which a groove 22*h* is formed so as to be inclined from, or in a certain situation parallel with, the center line of a metal pipe 21*h*. Then, as in the above embodiments, a through-hole 24*h* having a cylindrical burring wall that extends from the pipe inside circumferential surface is formed by pressing the thin portion, for example, inward by means of fluid pressure or a sphere. As in the above embodiments, the through-hole 24*h* of the metal pipe 21*h* thus formed is preferably longer than the thickness of the metal pipe 21*h* because of the formation of the cylindrical burring wall extending from the pipe inside circumferential surface of the metal pipe 21*h,* and an edge 26 is formed at the opening portion on the pipe outside circumferential surface side.

By using the through-holes 24 and 24*h* as branch holes for nozzles, the metal pipes 21 and 21*a*–21*h* formed with the through-holes 24 and 24*a*–24*h* can be used as they are as, for example, a cooling oil jet pipe for cooling the cylinder or the piston of an engine or a lubrication oil jet pipe that is used in a system for supplying (jetting) a lubricant to a sliding portion such as a crank shaft or a cam shaft. If necessary, nozzle pipes may be connected to the through-holes in the manner as shown in FIGS. 8(A) and 8(B) or FIGS. 9(A) and 9(B) to change the oil jetting direction or make the jetting outlets closer to an object, or branch pipes for general piping may be connected to the through-holes,.

As described above, the invention provides the following advantages:

(1) Since a through-hole is formed by a press method using a punch or by means of fluid pressure or a sphere, chips or sputters are not generated.

(2) A cylindrical burring wall can easily be formed on the pipe inside or outside circumferential surface side, and a sufficient through-hole length for, for example, brazing to nozzle pipes or branch pipes can be secured.

(3) The thickness of a hole-forming portion is decreased in advance, no recess (shearing droop) occurs at the opening portion of a through-hole on the pipe outside surface side and an edge shape can be formed there.

(4) A through-hole having a cylindrical burring wall can be formed so as to be inclined from the center line of a metal pipe by an arbitrary angle, or can be formed along a line that does not pass through the center line of a metal pipe.

(5) When a nozzle pipe or a branch pipe is brazed to a through-hole having a burring wall that projects from the inside or outside circumferential surface of a metal pipe, the brazing strength and the stability of the jetting direction can be increased because the brazing area is increased by the burring wall.

(6) A very fine through-hole of 0.6–1.0 mm in diameter can be formed by a press method using a punch.

(7) Having a constant diameter, a through-hole enables a constant flow rate when it is used as an oil jetting hole. Since the boundary between the pipe outside circumferential surface and the through-hole assumes an edge shape, the shape of an oil jet as output is stabilized and divergence of an oil jet can be prevented. Further, the jetting direction of an oil jet can be stabilized by virtue of the action of the burring wall.

(8) Because a core bar is not needed to form a through-hole, a through-hole can be formed quickly and properly at an arbitrary position of a metal pipe. A through-hole can be formed even in a portion between bent portions formed by bending a metal pipe.

What is claimed is:

1. A method for forming a through-hole through a circumferential wall of a metal pipe, said circumferential wall having opposite inside and outside circumferential surfaces and a longitudinal axis, said method comprising the steps of:

cutting the outside circumferential surface of the metal pipe to form a thin portion extending only partly through the circumferential wall; and pressing the thin portion with sufficient force for forming a through-hole in the thin portion, and, at the same time, forming a cylindrical burring wall on portions of the circumferential wall of the metal pipe surrounding the through hole.

2. The method according to claim 1, wherein the through-hole is formed by pressing the thin portion from outside with a punch.

3. The method according to claim 1, wherein the through-hole is formed by pressing the thin portion with fluid pressure.

4. The method according to claim 1, wherein the cutting step comprises cutting the outside circumferential surface in a direction substantially transverse to the longitudinal axis.

5. The method according to claim 4, wherein the step of forming a transverse cut is formed by rotating a grind stone against the outside circumferential surface, such that said thin portion defines an outwardly facing concave region on said outside circumferential surface.

6. The method according to claim 4, wherein the step of forming a transverse cut comprises moving a blade substantially linearly such that said thin portion defines a groove on said outside circumferential surface.

7. The method according to claim 1, wherein the pressing of the thin portion is carried out such that the through-hole and the cylindrical burring are aligned substantially along a radius of the circumferential wall.

8. The method according to claim 1, wherein the pressing of the thin portion is carried out such that the through-hole and the cylindrical burring are aligned substantially parallel to a radius of the circumferential wall and offset from the longitudinal axis.

9. The method according to claim 1, wherein the pressing of the thin portion is carried out such that the through-hole and the cylindrical burring are aligned substantially at an angle to a radius of the circumferential wall.

10. The method according to claim 1, wherein the inside and outside circumferential surfaces are spaced from one another to define a thickness at locations spaced from the thin portion, and wherein the pressing step is carried out such that the through hole and the cylindrical burring wall define a combined length greater than the thickness of the cylindrical wall.

11. A method for forming a through-hole through a circumferential wall of a metal pipe, said circumferential wall having opposite inside and outside circumferential surfaces, said method comprising the steps of:

forming a thin portion in the circumferential wall by cutting the outside circumferential surface only partly through the circumferential wall and thereby removing a portion of the outside circumferential surface of the metal pipe; and forming a through-hole by pressing the thin portion from outside with a punch with sufficient force for simultaneously forming a cylindrical burring wall on an inside circumferential surface of the metal pipe at a location on the inside circumferential surface aligned with the through-hole.

12. A method for forming a through-hole through a circumferential wall of a metal pipe, said circumferential wall having opposite inside and outside circumferential surfaces, said method comprising the steps of:

forming a thin portion in the circumferential wall by cutting the outside circumferential surface substantially transverse to the metal pipe for removing a portion of the outside circumferential surface of the metal pipe; and forming a through-hole by pressing the thin portion with fluid pressure, and, at the same time, forming a cylindrical burring wall on a selected one of the inside or outside circumferential surfaces of the metal pipe.

13. A metal pipe having a circumferential wall with opposite inside and outside circumferential surfaces, the metal pipe being formed with a thin portion in the circumferential wall formed by cutting the outer circumferential surface transverse to the circumferential wall and removing an outside circumferential surface portion the metal pipe, the thin portion defining a surface area, a through-hole formed through the thin portion of circumferential wall, the through-hole having a cross-sectional area smaller than the area of the thin portion, a burring wall projecting from the circumferential wall of the metal pipe and aligned substantially concentrically with the through-hole.

14. The metal pipe of claim 13, wherein the burring wall projects inwardly from said inside circumferential surface of said circumferential wall.

15. The metal pipe of claim 13, wherein the burring wall projects outwardly from the thin portion.

16. The metal pipe of claim 13, wherein the through-hole is disposed substantially symmetrically on the thin portion.

17. The metal pipe of claim 13, wherein the through-hole and the burring wall are aligned with a radius of the circumferential wall.

18. The metal pipe of claim 13, wherein the through-hole and the burring wall are aligned parallel to a radius of the circumferential wall.

19. The metal pipe of claim 13, wherein the through-hole and the burring wall are aligned at an angle to a radius of the circumferential wall.

* * * * *